United States Patent [19]

Lipani

[11] 4,038,076

[45] July 26, 1977

[54] PROCESS FOR PRODUCING ELECTROSTATOGRAPHIC PRINTS

[75] Inventor: Anthony F. Lipani, Webster, N.Y.

[73] Assignee: Xerox Corporation, Stamford, Conn.

[21] Appl. No.: 561,959

[22] Filed: Mar. 25, 1975

Related U.S. Application Data

[62] Division of Ser. No. 274,394, July 24, 1972, Pat. No. 3,926,824.

[51] Int. Cl.[2] ..... G03G 13/14

[52] U.S. Cl. ..... 96/1 SD; 96/1.3; 96/1.4; 252/62.1 P

[58] Field of Search ..... 96/1 SD, 1.4, 1.3; 252/62.1

[56] References Cited

U.S. PATENT DOCUMENTS

| | | | |
|---|---|---|---|
| 2,638,416 | 5/1953 | Walkup | 252/62.1 |
| 3,240,212 | 3/1966 | Royster | 131/9 |
| 3,650,797 | 3/1972 | Tomanek | 252/62.1 |

*Primary Examiner*—John D. Welsh

*Attorney, Agent, or Firm*—James J. Ralabate; Ernest F. Chapman

[57] ABSTRACT

Positive and negative copies are formed from both positive and negative originals by developing with both positively and negatively charged toner and selectively transferring toner of one polarity to produce a positive or negative print. The developer may be comprised of two toners and a single carrier; two carriers and a single toner or a single toner and a single carrier.

17 Claims, No Drawings

PROCESS FOR PRODUCING ELECTROSTATOGRAPHIC PRINTS

This is a division, of application Ser. No. 274,394, filed July 24, 1972 now U.S. Pat. No. 3,926,824.

This invention relates to electrostatography, and more particularly to improved electrostatographic developing materials and the use thereof.

Electrostatography is best exemplified by electrophotography. The basis electrophotographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting latent electrostatic image by depositing on the image a finely divided electroscopic material referred to in the art as "toner." The toner will normally be attracted to those areas of the layer which retain a charge, thereby forming a toner image corresponding to the latent electrostatic image. This powder image may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing steps The electrophotographic processes generally involve positive to positive development; i.e., the production of a positive print from a positive original. In some cases, however, negative to positive development is required; i.e., the production of a positive print from a negative original.

The production of positive prints from negative originals generally involves a change in the developing material. In accordance with this technique, the electrostatographic recording surface is positively charged and exposed to the negative original, resulting in a discharge of the image areas, with a negative charge being induced on the surface of the recording surface near the edges of the image area as a result of the fringing field effect. The use of a positively charged toner results in a deposition of the toner in the negatively charged areas, resulting in the development of a positive image on the recording surface, which can then be transferred as known in the art. In the case of a negatively charged recording surface, the use of a negatively charged toner will result in the development of a positive image.

The production of positive prints from solid area negatives is generally effected by the use of a development electrode. In accordance with this technique, the recording surface is positively charged, and exposed to a solid area negative, resulting in discharge of the image areas and retention of the charge in the non-image areas. A development electrode is positioned opposite the recording surface and is provided with a potential equal to the potentional on the recording surface in the non-discharged areas. As a result of these conditions, negative charges are induced which exactly neutralize the positive charges on the recording surface in the non-discharged areas, and in the image areas where the positive charge on the recording surface is zero, no neutralization occurs and a negative charge is induced on such areas. The use of a positive toner results in the development of a positive image on the recording surface. In the case of a negatively charged recording surface, a negative potential is applied to the development electrode, and the induced positive charge, in the image areas, is developed with a negative toner to produce a positive image on the recording surface.

While the above techniques are capable of producing positive copies from both positive and negative originals, such techniques suffer from certain deficiencies; in particular the production of a machine which is capable of being easily used for producing, for example, positive prints from both positive and negative originals. In accordance with the prior art, a user employed either two different machines or a single machine with the capability of changing the toner in order to be able to provide positive prints from both positive and negative originals. The use of two machines entails higher costs and the changing of toner requires the expenditure of unnecessary time. Accordingly, there is a need for a development technique which is capable of producing both positive and negative copies from both positive and negative originals.

An object of the present invention is to provide for improved electrostatographic development.

Another object of the present invention is to provide for electrostatographic development capable of producing both negative and positive copies from both negative and positive originals.

A further object of this invention is to provide for electrostatographic development capable of producing both negative and positive copies from both negative and positive originals without changing developer.

These and other objects of the present invention should be apparent to those skilled in the art from the teachings herein.

The objects of this invention are broadly accomplished, in one aspect, by forming an electrostatographic latent image corresponding to a positive or negative original and subsequently developing the latent image with both positively and negatively charged toner whereby toner of one polarity is deposited in the image area and toner of the other polarity is deposited in at least the background area immediately adjacent the image area. A positive or negative print of the original is then produced by transferring toner of one polarity to a receiving surface.

In accordance with the present invention, the positive and negative toner used in the development may be provided by the use of: two different toners and a single carrier with the two toners being selected with respect to their triboelectric properties so that one of the toners is above and the other below the carrier material in the triboelectric series whereby the carrier material imparts a positive charge to one toner and a negative charge to the other; a single toner and two different carriers with at least the surface of the two carriers being formed of materials selected with respect to their triboelectric properties so that one of the carriers is above and the other below the toner in the triboelectric series whereby one carrier imparts a negative charge to the toner and the other carrier a positive charge to the toner; or a single toner and a single carrier with at least the surface of the carrier being formed of a material which is capable of imparting both a negative and a positive charge to a single toner.

In accordance with a preferred embodiment of the present invention development is effected by the use of a developer of a single toner electrostatically coated on a single carrier, the toner being both positively and negatively charged. In this manner, a single developer may be employed to provide both electropositive and electronegative toner.

In accordance with the present invention, at least the surface of an electrostatographic developer carrier is formed of a material which is capable of imparting both a negative and a positive charge to a single toner. The carrier may have at least its surface formed from either a single component, as in the case of an electret, as hereinafter described, or from two or more components, with such two or more components being selected with respect to their triboelectric properties so that one of the materials is above, and the other below, a single toner in the triboelectric series, whereby the single toner is triboelectrically positively and negatively charged by the carrier surface.

In producing a single carrier from two or more materials, such materials are intimately mixed with each other (the two materials are incompatible; i.e., the materials do not produce solid solutions.) In a manner such that the domain size of each of the components is at least equal to the average particle size of the toner to be employed, whereby each of the components is capable of imparting the desired charge to the toner. It is to be understood that the domain size of each of the components could be larger than the average particle size of the toner, and in some cases, slightly smaller than the average particle size of the toner, provided the domain size is of a size sufficient to impart the desired charge to the single toner.

The intimate mixture of the two or more components may be formed by intimately mixing the components; e.g., by milling, as known in the art. Alternately, one of the components may be formed with pores and vacuum impregnated or otherwise filled with the other component. It is to be understood that the domain size of each of the various components may be controlled in such techniques by selection of the particle size of the components and the pore size of the porous material, respectively. The precise method of producing an intimate mixture of the at least two components is deemed to be within the scope of those skilled in the art from the teachings herein and no further explanation is deemed necessary for a complete understanding of the present invention.

The carrier surface thereof could also be comprised of a single component; e.g., an electret; an electret is a material which will sustain the coexistence of segregated positive and negative charges which are in close proximity to each other. As should be apparent, an electret, as a result of the coexistence of segregated positive and negative charges, is capable of charging a single toner both electropositively and electronegatively. Electrets are disclosed in more detail in the following articles: F. Gutman, *Review of Modern Physics* 20, pp. 457–472, (July 1948); Turek, *Direct Current,* pp. 204–211, (Dec. 1959); and Wiseman et al., *Electrical Engineering,* pp. 869–872, (Oct. 1953). An electret particularly preferred for the purposes of the present invention is one formed from calcium titanate. In view of the fact that electrets and the properties thereof are known in the art, no further discussion thereof is deemed necessary for a full understanding of the invention.

Alternatively, as hereinabove described, the developer of the present invention could be comprised of two carriers and a single toner with at least the surface of each of the carriers being formed of two different components, one of which is capable of imparting a positive charge to the toner and other of which is capable of imparting a negative charge to the toner. As a further alternative two different toners may be employed with a single carrier with one toner being capable of being charged negatively by the carrier and the other toner being capable of being charged positively by the carrier. The materials which are to be employed for producing the developers of the present invention may be readily selected by referring to any of the triboelectric series known in the art. As representative examples of such triboelectric series, there may be mentioned the following: Shaw and Levy, E. W. L. Proc. of Royal Society, 138, p. 506 (1932); The Smithsonian series, published in Smithsonian Physical Tables, p. 375, 9th Rev. Ed. (1954); and Hersh and Montgomery Textile Research Laboratories, 28, p. 903 (1956).

As representative examples of materials which are generally electropositive (these materials impart a negative charge to the toner), there may be mentioned: glass, metal oxides, such as calcium oxide, titanium oxide, iron oxide, calcium titanate, etc.; metals, such as lead, nickel, copper, etc.; ferrite; polymers such as ethyl cellulose, acrylic polymers, acrylate polymers, etc.; and the like. As representative examples of materials which are generally electronegative (these materials impart a positive charge to the toner), there may be mentioned: metals such as selenium; polymers such as halopolymers e.g., polymers of tetrafluoroethylene, polymers of vinyl chloride, polymers of vinyl fluoride, polymers of vinylidene fluoride, polymers of chlorotrifluoroethylene; butyl rubber: and the like. The selection of the required materials is deemed to be within the scope of those skilled in the art from the teachings herein.

The concentration of toner (ratio of toner to carrier) and the relative proportions of electropositive and electronegative material used in two different carriers or in a single carrier, in accordance with the present invention, has been found to affect print quality. Thus, for example, at increasing toner concentrations, background and image densities increase, and in addition, the "Halo" effect (the "halo" is a concentration of background in the area immediately around the images) increases. The selection of the optimum toner concentration and the optimum electropositive carrier material to electronegative carrier material ratio is governed by the particular toners and carriers used. The selection of optimum concentrations and proportions may be easily accomplished by a series of tests. In most cases, a toner concentration of from about 0.9 to 1.2 weight percent provides the best results. In using two different carrier material components either in a single carrier or in two different carriers, in general, best results are achieved with a weight ratio of electropositive to electronegative of from about 1:1.2 to about 1/1.5. It is to be understood, however that the scope of the present invention is not to be limited by such proportions and/or concentrations.

The developer carriers employed in the present invention are preferably of the type used in the cascade development process, and the production of such carriers is deeemed to be within the scope of those skilled in the art. It is to be understood, however, that the teachings of the present invention are not limited to such carriers. Thus, for example, development can be effected by fur brush development by using a brush in which: the fibers are of the same material and two different toners are employed one of which is positively charged by the brush material and the other of which is negatively charged by the brush material; some of the fibers are formed of one material which is capable of charging a single toner positively and some of the fibers are formed of another material which is capable of charging the single toner negatively; or the fibers may be formed of a composite of materials one of which positively charges the toner and other of which negatively charges the toner. It is also to be understood that a cascade development type of developer may be employed to develop images, as known in the art, by techniques other than cascade development; e.g., magnetic brush development, fluidized development, etc.

The toners used in the present invention may be any one of the wide variety of pigmented or dyed resins used in the art, with the resin generally containing a dye or pigment in a quantity up to about 25% by weight, and particularly from about 1 to about 20% by weight, of the toner.

Typical toner materials include: gum copal, gum sandarac, rosin, cumaroneindene resin, asphaltum, gilsonite, phenol-formaldehyde resins, rosin-modified phenol-formaldehyde resins, methacrylic resins, polystyrene resins, polypropylene resins, epoxy resins, polyethylene resins, polyamide resins, and mixtures thereof. The particular toner material to be employed obviously depends upon the separation of the toner particles from the carrier in the triboelectric series. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. No. Re. 25,136 to Carlson and U.S. Pat. No. 2,788,288 to Rheinfrank et al. These toners generally have an average particle diameter between about 1 and about 30 microns.

The colored toner may be prepared by any one of a wide variety of procedures for forming a uniform dispersion of the dye or pigment in the resinous material. Thus, for example, the resinous material and a suitable pigment may be heated and blended on a rubber mill and then allowed to cool and harden to encase the pigment within the resinous material. The pigmented or dyed resinous material is then micronized; e.g., in a jet pulverizer, to particles having a particle size generally employed for a toner. Alternatively, the finely divided toner may be prepared by spray drying a toner composition of the colorant and resin dissolved in a solvent.

The above procedures and other procedures for producing colored toner of the desired particle size are generally known in the art and may be employed for producing the toner of the present invention and, therefore, no detailed discussion thereof is necessary for a full understanding of the invention.

The toner may also include other materials generally employed for modifying the characteristics of a toner, such as conductive materials to modify the triboelectric properties thereof, magnetic materials to modify the physical properties of the toner or the like, and the use of such materials is deemed to be within the scope of those skilled in the art from the teachings herein.

The developers of the present invention, as hereinabove noted, are preferably of the type used in the cascade development technique, as more fully described in U.S. Pat. No. 2,618,551 to Walkup, U.S. Pat. No. 2,618,552 to Wise and U.S. Pat. No. 2,638,416 to Walkup et al. In the cascade development technique, the carrier particles are larger than the toner particles by at least one order of magnitude of size and are shaped to roll across the latent image-bearing surface. In general, the carrier particles should be of sufficient size so that their gravitational or momentum force is greater than the force of attraction of the toner particles in the area of the image-bearing surface where the toner particles are retained, whereby the carrier will not be retained by the toner particles which are attracted to the image-bearing surface. The carrier particles generally have a particle size from about 30 to about 1000 microns, but it is to be understood, that the carrier particles may be of a size other than as particularly described, provided that the carrier flows easily over the image-bearing surface, without requiring special means for effecting removal of the carrier particles from the image-bearing surface.

The cascade development type of developer, comprised of toner and carrier, as hereinabove described, may also be used for developing electrostatic latent images by other techniques, such as magnetic brush development and fluidized development, and such uses are within the spirit and scope of the present invention.

The developers of the present invention may be used for producing positive or negative copies from positive or negative originals.

Thus, for example, in the case of a positive line original, the electrostatographic recording surface may be positively charged and exposed to the positive original, resulting in dissipation of the charge in the non-image area and retention of the charge in the image area, with a negative charge being induced around the edges of the image area as a result of the fringing field effect. In employing a developer of the present invention, the electropositive portion of the toner is deposited in the fringe areas around the image, and the electronegative portion of the toner is deposited in the image area, whereby both a positive and negative image is produced on the recording surface, i.e., the negative toner portion defines a positive image on the recording surface and the positive toner portion defines a negative image on the recording surface. If a positive reproduction of the positive original is desired, transfer is effected by the use of a positive charge whereby only the negative toner portion, defining the positive image, is transferred to the support surface. If a negative reproduction of the positive original is desired, transfer is effected by the use of a negative charge, whereby only the positive toner portion, defining the negative image, is transferred to the support surface. Similarly, if the recording surface is originally charged negatively, there will be a negative charge in the image areas and an induced positive charge in the fringe areas. In this case, the negative portion of the toner defines the negative image, and the positive portion of the toner defines the positive image, and either a positive or negative copy may be produced by appropriate selection of the polarity of the charge used for transferring of the toner to the support surface.

In the case of a negative line original, the electrostatographic recording surface may be positively charged and exposed to the negative original, resulting in dissipation of the charge in the image area, and retention of the charge in the non-image area, with a negative charge being induced around the edges of the image area as a result of the fringing field effect. In employing a developer of the present invention, the electropositive portion of the toner is deposited in the image areas and the electronegative portion of the toner is deposited in the image areas and the electronegative portion of the toner is deposited in the fringe area around the image, whereby both a positive and negative image is produced on the recording surface; i.e., the negative toner portion defines a negative image on the recording surface and the positive toner portion defines a positive image on the recording surface. If a positive reproduction of the negative original is desired, transfer is effected by the use of a negative charge, whereby only the positive toner portion, defining the positive image, is transferred to the support surface. If a negative reproduction of the negative original is desired, transfer is effected by the use of a positive charge, whereby only the negative toner portion, defining the negative image, is transferred to the support surface Similarly, if the recording surface is originally charged negatively, there will be a negative charge in the non-image areas and an induced positive charge around the fringe of the image areas. In this case, the positive portion of the toner defines the negative image, and the negative portion of the toner defines the positive images, and either a positive or negative copy may be produced by appropriate selection of the polarity of the charge used for transferring of the toner to the support surface.

In the case of solid area originals, both positive and negative copies may be produced from both positive and negative solid area originals, as hereinabove described, except that as known in the art, a development electrode is employed to increase the field above the solid areas.

The present invention is further described with respect to the following examples. In these examples, unless otherwise specified, all parts and proportions are by weight.

EXAMPLE I

A solid composite of barium ferrite in butyl rubber, containing 60% barium ferrite, is broken into small pieces (size 20–40 mesh) and used as an electrostatographic development carrier with a toner comprising styrene-n-butyl methacrylate copolymer, polyvinyl butyral and carbon black produced as disclosed in Example I of U.S. Pat. No. 3,079,324 to Insalaco, the developer composition containing 1%, by weight, of the toner.

The developer is used to develop an electrostatic latent image formed from a positive original on a flat selenium plate charged to +700 volts by cascading the developer (three times) over the plate.

The image is transferred to paper using +700 volts and a positive copy of the positive original is produced.

The above is repeated, except that the image was transferred using −700 volts, and a negative copy of the positive original is produced.

The above is repeated except that a negative original is used and upon transfer with +700 volts a negative-looking copy, i.e., light print on dark background, of the negative original is produced. Transfer effected with −700 volts produces a positive-looking, i.e., dark print on light background copy of the negative original.

EXAMPLE II

Selenium is melted and calcium titanate having an average particle size of 15 microns is uniformly dispersed in the selenium to provide a composite having 40%, by weight, calcium titanate. The composite is formed into particles (size 20–40 mesh) for use as an electrostatographic development carrier and combined with 1%, by weight, of the toner described in Example I.

The developer is used to develop an electrostatic latent image formed from a positive original on a flat selenium plate charged to +700 volts by cascading the developer (three times) over the plate.

The image is transferred to paper using +700 volts and a positive copy of the positive original is produced.

The above is repeated, except that the image was transferred using −700 volts, and a negative copy of the positive original is produced.

The above is repeated except that a negative original is used and upon transfer with +700 volts a negative copy of the negative original is produced. Transfer effected with −700 volts produces a positive copy of the negative original.

EXAMPLE III

A developer carrier of 250 micron steel beads coated with a polymer mixture of vinyl chloride - vinyl acetate polymer and styrenemethyl methacrylate - vinyl triethoxy silane polymer (1:1 weight ratio of polymers) is combined with 2%, by weight, of the toner described in Example I.

The developer is used to develop an electrostatic latent image formed from a positive original on a flat selenium plate charged to +700 volts by cascading the developer (three times) over the plate.

The image is transferred to paper using +700 volts and a positive copy of the positive original is produced.

The above is repeated, except that the image was transferred using −700 volts, and a negative copy of the positive original is produced.

The above is repeated, except that a negative original is used and upon transfer with +700 volts a negative copy of the negative original is produced. Transfer effected with −700 volts produces a positive copy of the negative original.

EXAMPLE IV

An electret of calcium titanate having segregated positive and negative charges is combined with 2%, by weight, of the toner described in Example I.

The developer is used to develop an electrostatic latent image formed from a positive original on a flat selenium plate charged to +700 volts by cascading the developer (three times) over the plate.

The image is transferred to paper using +700 volts and a positive copy of the positive original is produced.

The above is repeated, except that the image was transferred using −700 volts, and a negative copy of the positive original is produced.

The above is repeated except that a negative original is used and upon transfer with +700 volts a negative copy of the negative original is produced. Transfer effected with −700 volts produces a positive copy of the negative original.

EXAMPLE V

A developer carrier (20–40 mesh) of polytetrafluoroethylene having dispersed therein copper metal (particle size of greater than 20 microns) in a weight ratio of about 1:1 is combined with 1%, by weight, of the toner of Example I.

The developer is used to develop an electrostatic latent image formed from a positive original on a flat selenium plate charged to +700 volts by cascading the developer (three times) over the plate.

The image is transferred to paper using +700 volts and a positive copy of the positive original is produced.

The above is repeated, except that the image was transferred using −700 volts, and a negative copy of the positive original is produced.

The above is repeated except that a negative original is used and upon transfer with +700 volts a negative copy of the negative original is produced. Transfer effected with −700 volts produces a positive copy of the negative original.

EXAMPLE VI

A developer carrier of 250 micron sand coated with a mixture of ethyl cellulose and poly vinyl fluoride (1:1 weight ratio) is combined with 2%, by weight, of the toner described in Example I.

The developer is used to develop an electrostatic latent image formed from a positive original on a flat selenium plate charged to +700 volts by cascading the developer (three times) over the plate.

The image is transferred to paper using +700 volts and a positive copy of the positive original is produced.

The above is repeated, except that the image was transferred using −700 volts, and a negative copy of the positive original is produced.

The above is repeated except that a negative original is used and upon transfer with +700 volts a negative copy of the negative original is produced. Transfer effected with −700 volts produces a positive copy of the negative original.

EXAMPLE VII

A developer carrier (20–40 mesh) of polytetrafluoroethylene having dispersed therein 40%, by weight, of titanium dioxide (particle size of greater than 20 microns) is combined with 1%, by weight, of the toner of Example I.

The developer is used to develop an electrostatic latent image formed from a positive original on a flat selenium plate charged to +700 volts by cascading the developer (three times) over the plate.

The image is transferred to paper using +700 volts and a positive copy of the positive original is produced.

The above is repeated, except that the image was transferred using −700 volts, and a negative copy of the positive original is produced.

The above is repeated except that a negative original is used and upon transfer with +700 volts a negative copy of the negative original is produced. Transfer effected with −700 volts produces a positive copy of the negative original.

EXAMPLE VIII

A developer carrier (20–40 mesh) of polyvinyl chloride having dispersed therein 40%, by weight, of barium ferrite (particle size of greater than 20 micron) is combined with 1%, by weight, of the toner of Example I.

The developer is used to develop an electrostatic latent image formed from a positive original on a flat selenium plate charged to +700 volts by cascading the developer (three times) over the plate.

The image is transferred to paper using +700 volts and a positive copy of the positive original is produced.

The above is repeated, except that the image was transferred using −700 volts, and a negative copy of the positive original is produced.

The above is repeated except that a negative original is used and upon transfer with +700 volts a negative copy of the negative original is produced. Transfer effected with −700 volts produces a positive copy of the negative original.

EXAMPLE IX

A developer carrier (20–40 mesh) of selenium having dispersed therein 40%, by weight, of iron (particle size of greater than 20 microns) is combined with 2%, by weight, of the toner of Example I.

The developer is used to develop an electrostatic latent image formed from a positive original on a flat selenium plate charged to +700 volts by cascading the developer (three times) over the plate.

The image is transferred to paper using +700 volts and a positive copy of the positive original is produced.

The above is repeated, except that the image was transferred using −700 volts, and a negative copy of the positive original is produced.

The above is repeated except that a negative original is used and upon transfer with +700 volts a negative copy of the negative original is produced. Transfer effected with −700 volts produces a positive copy.

EXAMPLE X

Examples I - IX are repeated with a toner comprising a propoxylated bisphenol A fumarate polyester (ATLAC 382, sold by Atlas Chemical Industries Inc.) and carbon black (5%) with similar results.

EXAMPLE XI

A Xerox microprinter commercially available from Xerox Corporation in Stamford, Conn., is modified by the addition of a 720 DC power supply and the installation of a transfer coratron polarity switch to provide for rapid switching from positive to negative mode copying and vice versa.

A developer is formed from the toner of Example I and a first carrier (electropositive) of 600 micron diameter flintshot coated with styrene - methyl methacrylate - vinyl triethoxy silane polymer and a second carrier (electronegative) of 600 micron diameter flintshot coated with vinyl chloride - vinyl acetate polymer.

The developer is used in various runs at electropositive to electronegative carrier weight ratios which range from 1/1.23 to 1/1.44 and toner concentrations which range from about 0.9 to about 1.2 percent, by weight. Transfer is effected in both the positive mode (positive copy from positive original) and the negative mode (positive copy from negative original) at 10.5 amp.

The printer is operated in both the positive and negative mode and prints of satisfactory quality are obtained in both modes. The prints, in both the positive and negative mode, generally have an image density of greater than 1.2, a background density of less than 0.03, and a resolution of generally about 5 - 7 line pairs per millimeter.

The present invention is particularly advantageous in that a single machine is capable of producing either positive or negative prints from either positive or negative originals by selecting the charge of polarity placed on the toner receiving surface during transfer. In a commercial machine, the addition of a simple switch which alters the polarity of charge placed on the paper during transfer provides the desired flexibility.

The use of a single carrier and a single toner to provide both negatively and positively charged toner is particularly advantageous in that there is no necessity to coordinate the amounts of two or more toners, and/or carriers as would be required in the case where more than one carrier and/or toner is employed to provide both negative and positive toner.

These and other advantages of the present invention should be apparent from the teachings herein.

Numerous modifications and variations of the present invention are possible in light of the above teachings and, therefore, within the scope of the appended claims, the invention may be practised otherwise than as particularly described.

What is claimed is:

1. A process for producing positive and negative prints from both positive and negative originals, comprising:

forming an electrostatic latent image from said original; developing the electrostatic latent image with a developer having only one type of finely divided toner particles and only one type of carrier therefor the carrier particles being larger than the toner particles, at least the surface of said carrier comprising material which is capable of imparting both a negative and a positive charge to said toner whereby said toner electrostatically adhering to said carrier is both negatively and positively charged on said carrier, whereby toner of one polarity is deposited in the image area and toner of the other polarity is deposited in at least the background area immediately adjacent the image area without providing two or more types of toner and/or carrier particles; and transferring toner of one polarity to a receiving surface to produce a positive or negative print.

2. A process for producing positive and negative prints from both positive and negative originals, comprising:

forming an electrostatic latent image from said original; developing the electrostatic latent image with a developer having only one type of finely divided toner particles and only one type of carrier therefor the carrier particles being larger than the toner particles, at least the surface of said carrier comprising a material which is an electret capable of imparting both a negative and a positive charge to said toner whereby said toner electrostatically adhering to said carrier is both negatively and positively charged on said carrier, whereby toner of one polarity is deposited in the image area and toner of the other polarity is deposited in at least the background area immediately adjacent the image area without providing two or more types of toner and/or carrier particles; and transferring toner of one polarity to a receiving surface to produce a positive or negative print.

3. A process for producing positive and negative prints from both positive and negative originals, in accordance with claim 2 wherein the material which is an electret is calcium titanate.

4. A process for producing positive and negative prints from both positive and negative originals, comprising:

forming an electrostatic latent image from said original; developing the electrostatic latent image with a developer having only one type of finely divided toner particles and only one type of carrier therefor the carrier particles being larger than the toner particles, at least the surface of the carrier being formed of at least two incompatible materials one of which is triboelectrically negative with respect to said toner and the other of which is triboelectrically positive with respect to said toner, and said incompatible materials are capable of imparting both a negative and a positive charge to said toner, whereby said toner electrostatically adhering to said carrier is both negatively and positively charged on said carrier, immediately adjacent the image area without providing two or more types of toner and/or carrier particles; and transferring toner of one polarity to a receiving surface to produce a positive or negative print.

5. A process for producing positive and negative prints from both positive and negative originals, in accordance with claim 4 where said at least two materials are present on the surface of said carrier in a domain size which is at least about the average particle size of said toner.

6. A process for producing positive and negative prints from both positive and negative originals, in accordance with claim 4 wherein said carrier is a coated carrier said at least two materials forming the coating of said carrier.

7. A process for producing positive and negative prints from both positive and negative originals in accordance with claim 4 wherein said carrier is an uncoated carrier and said uncoated carrier is comprised of said at least two materials.

8. A process for producing positive and negative prints from both positive and negative originals in accordance with claim 7 wherein the carrier comprises barium ferrite dispersed in rubber.

9. A process for producing positive and negative prints from both positive and negative originals in accordance with claim 7 wherein the carrier comprises calcium titanate dispersed in selenium.

10. A process for producing positive and negative prints from both positive and negative originals, comprising:

forming an electrostatic latent image from said original; developing said electrostatic latent image with a developer having both negatively and positively charged toner and carrier therefor, the toner being charged positively by the carrier and the toner being charged negatively by the carrier, whereby toner of one polarity is deposited in the image area and toner of the other polarity is deposited in at least the background area immediately adjacent the image area, and transferring toner of one polarity to a receiving surface to produce a positive or negative print.

11. A process for producing positive and negative prints from both positive and negative originals, comprising:

forming an electrostatic latent image from said original developing said electrostatic latent image with a developer having both negatively and positively charged toner, the developer comprising an electrostatographic developer carrier and two different toners one of which is positively charged by said carrier and the other of which is negatively charged by said carrier, whereby toner of one polarity is deposited in the image area and toner of the other polarity is deposited in at least the background area immediately adjacent the image area; and transferring toner of one polarity to a receiving surface to produce a positive or negative print.

12. A process for producing positive and negative prints from both positive and negative originals, comprising:

forming an electrostatic latent image from said original; developing said electrostatic latent image with a developer having both negatively and positivey charged toner, the developer comprising two different electrostatographic developer carriers and a single toner, one carrier charging said toner positively and the other carrier charging said toner negatively, whereby toner of one polarity is deposited in the image area and toner of the other polarity is deposited in at least the background area immediately adjacent the image area; and transferring toner of one polarity to a receiving surface to produce a positive or negative print.

13. The process of claim 10 wherein said original is a positive original and a positive copy is produced by electrostatically transferring toner to the receiving surface by a charge of the same polarity as a charge placed on an imaging surface on which said electrostatic latent image is formed.

14. The process of claim 10 wherein said original is a positive original and a negative copy is produced by electrostatically transferring toner to the receiving surface by a charge of a polarity opposite to that of a charge placed on an imaging surface on which the electrostatic latent image is formed.

15. The process of claim 10 wherein said original is a negative original and a negative copy is produced by electrostatically transferring toner to the receiving surface by a charge of the same polarity as a charge placed on an imaging surface on which said electrostatic latent image is formed.

16. The process of claim 10 wherein said original is a negative original and a positive copy is produced by electrostatically transferring toner to the receiving surface by a charge of a polarity opposite to that of a charge placed on an imaging surface on which the electrostatic latent image is formed.

17. A process for producing positive and negative prints from positive and negative originals in accordance with claim 4 wherein said coating comprises calcium titanate dispersed in selenium.

* * * * *